US005792029A

United States Patent [19]

Gordon

[11] Patent Number: 5,792,029

[45] Date of Patent: Aug. 11, 1998

[54] FOOT SKATE CLIMBING SIMULATION EXERCISE APPARATUS AND METHOD

[76] Inventor: Trace Gordon, 3880 W. Lariat Rd., Park City, Utah 84060

[21] Appl. No.: 604,510

[22] Filed: Feb. 21, 1996

[51] Int. Cl.[6] ..... A63B 22/04; A63B 22/00

[52] U.S. Cl. ..... 482/52; 482/70

[58] Field of Search ..... 482/51, 52, 53, 482/54, 70, 71

[56] References Cited

U.S. PATENT DOCUMENTS

| | | | |
|---|---|---|---|
| 219,439 | 9/1879 | Blend . | |
| D. 344,557 | 2/1994 | Ashby . | |
| 3,970,302 | 7/1976 | McFee . | |
| 4,470,597 | 9/1984 | McFee . | |
| 4,685,666 | 8/1987 | DeCloux . | |
| 4,733,858 | 3/1988 | Lan . | |
| 4,813,667 | 3/1989 | Watterson . | |
| 5,145,481 | 9/1992 | Friedebach . | |
| 5,282,776 | 2/1994 | Dalebout . | |
| 5,290,211 | 3/1994 | Stearns . | |
| 5,336,146 | 8/1994 | Piaget | 482/54 |
| 5,352,169 | 10/1994 | Eschenbach | 482/57 |
| 5,383,829 | 1/1995 | Miller | 482/57 |
| 5,401,226 | 3/1995 | Stearns . | |
| 5,540,637 | 7/1996 | Rodgers | 482/52 |

FOREIGN PATENT DOCUMENTS

| | | | |
|---|---|---|---|
| 2428515 | 1/1976 | Germany | 482/52 |

*Primary Examiner*—Richard J. Apley
*Assistant Examiner*—William LaMarca
*Attorney, Agent, or Firm*—Thorpe, North & Western, LLP

[57] ABSTRACT

An exercise apparatus. The apparatus includes first and second elongate support members pivotally mounted upon a support frame. First and second foot holders are moveably mounted upon the first and second support members, respectively, for supporting a user's feet thereon. The foot holders are moveable forwardly and backwardly along the support members. The combination of pivotal movement of the support members and linear movement of the foot holders relative to the support members enables the user to move each foot (i) simultaneously backwardly and downwardly and (ii) simultaneously forwardly and upwardly, in a reciprocating movement path without removing the feet from the foot holders.

20 Claims, 10 Drawing Sheets

FOOT SKATE CLIMBING SIMULATION EXERCISE APPARATUS AND METHOD

BACKGROUND OF THE INVENTION

1. The Field of the Invention

The present invention relates generally to exercise equipment. More particularly, it concerns an apparatus and method for utilizing a pair of reciprocating foot supports which are moveable forwardly, backwardly, upwardly and downwardly for climbing simulation exercise.

2. The Background Art

Modern exercise equipment has been developed to enable users to engage in vigorous aerobic exercise in a substantially stationary position. Some exercise machines are designed specifically for upper-body exercise, while others focus upon lower-body walking exercise. Still others have been designed to enable both upper- and lower-body exercise.

It is known to provide a treadmill having adjustable speed and resistance for lower-body exercise use. A user walks or jogs upon the circulating treadmill surface at a pace which is compatible with the circulation speed. U.S. Pat. No. 5,336,146 (issued Aug. 9, 1994 to Piaget and Gordon) discloses a treadmill exercise machine having dual treadmills which are independently pivotable upwardly and downwardly responsive to the user's walking or jogging motions.

An upper body exerciser is disclosed in U.S. Pat. No. 5,282,776 (issued Feb. 1, 1994 to Dalebout). A user grips a pair of arm handles and works them back and forth with the hands. The exerciser can be mounted to a support structure having another exercise device so that both exercise devices can be separately or simultaneously used to exercise.

Both upper- and lower-body exercise can be accomplished by using the exercise apparatus disclosed in U.S. Pat. No. 5,145,481 (issued Sep. 8, 1992 to Friedebach) . The apparatus is a ski exercise machine having movable arm poles and foot holding skates. The foot skates are attached to an adjustable resistance belt system, and the arm poles are pivotable about an adjustable resistance system. A user may engage in simultaneous upper- and lower-body exercise by working the arm poles with the hands and the foot skates with the feet.

OBJECTS AND SUMMARY OF THE INVENTION

It is an object of the present invention to provide an exercise apparatus for enabling a user to move each foot (i) simultaneously backwardly and downwardly and (ii) simultaneously forwardly and upwardly, in a reciprocating movement path, without having to lift the feet from the apparatus.

It is a further object of the invention to provide such an exercise apparatus which provides resistance to the reciprocating movement path of the user's feet.

It is another object of the invention to provide such an exercise apparatus which provides resistance to reciprocating forward and backward movement of the user's hands.

The above objects and others not specifically recited are realized in a specific illustrative embodiment of an exercise apparatus. The apparatus includes first and second elongate support members pivotally mounted upon a support frame. First and second foot holders are moveably mounted upon the first and second support members, respectively, for supporting a user's feet thereon. The foot holders are moveable forwardly and backwardly along the support members.

The combination of pivotal movement of the support members and linear movement of the foot holders relative to the support members enables the user to move each foot (i) simultaneously backwardly and downwardly and (ii) simultaneously forwardly and upwardly, in a reciprocating movement path without removing the feet from the foot holders.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
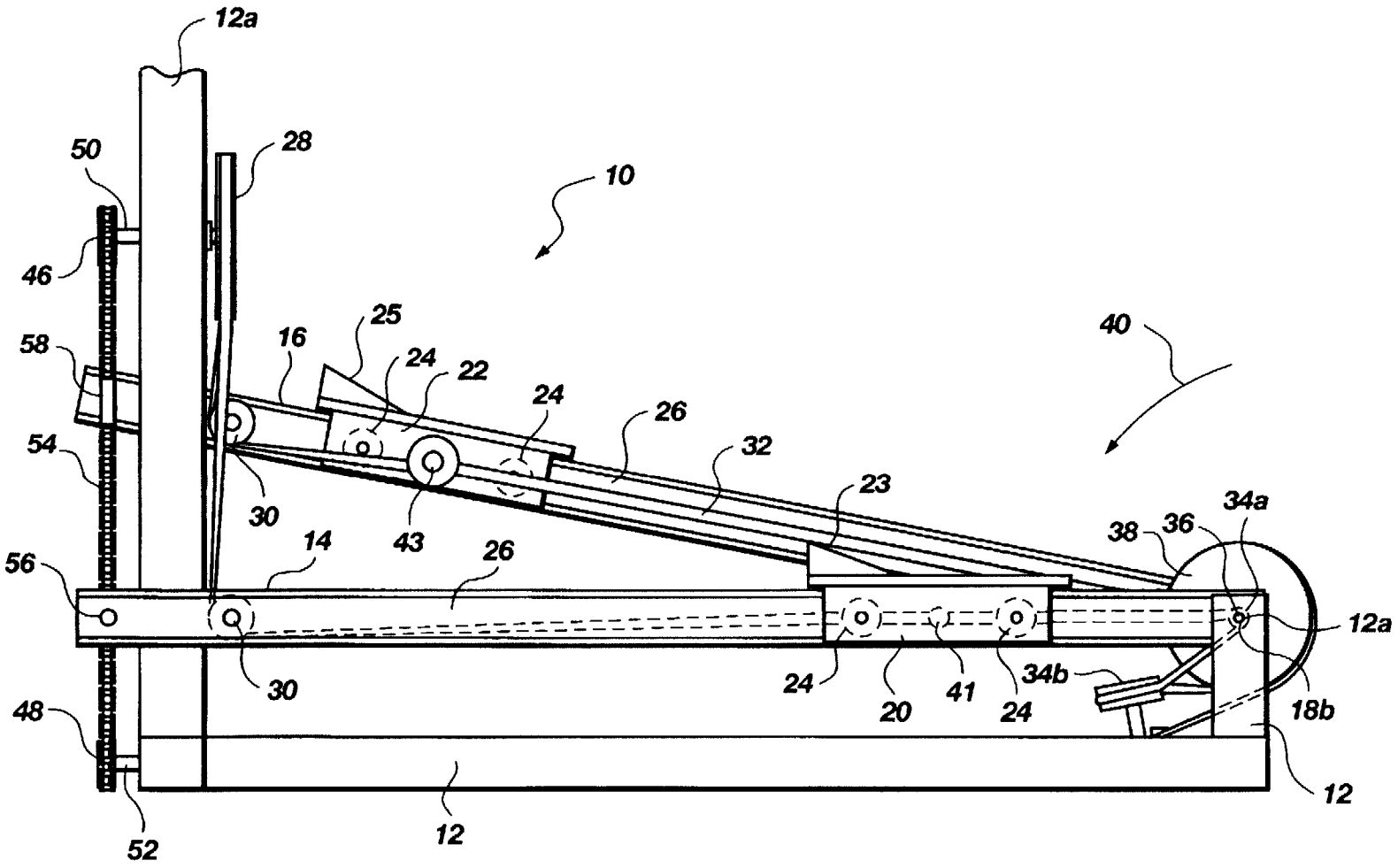
FIG. 1 is a side view of an exercise apparatus made in accordance with the principals of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

Applicant has discovered that stationary lower-body exercise can be accomplished by a novel machine which enables a user to move each foot (i) simultaneously backwardly and downwardly and (ii) simultaneously forwardly and upwardly, in a reciprocating movement path. Further, this can be achieved without the user having to lift the feet from the apparatus.

Figure 2:
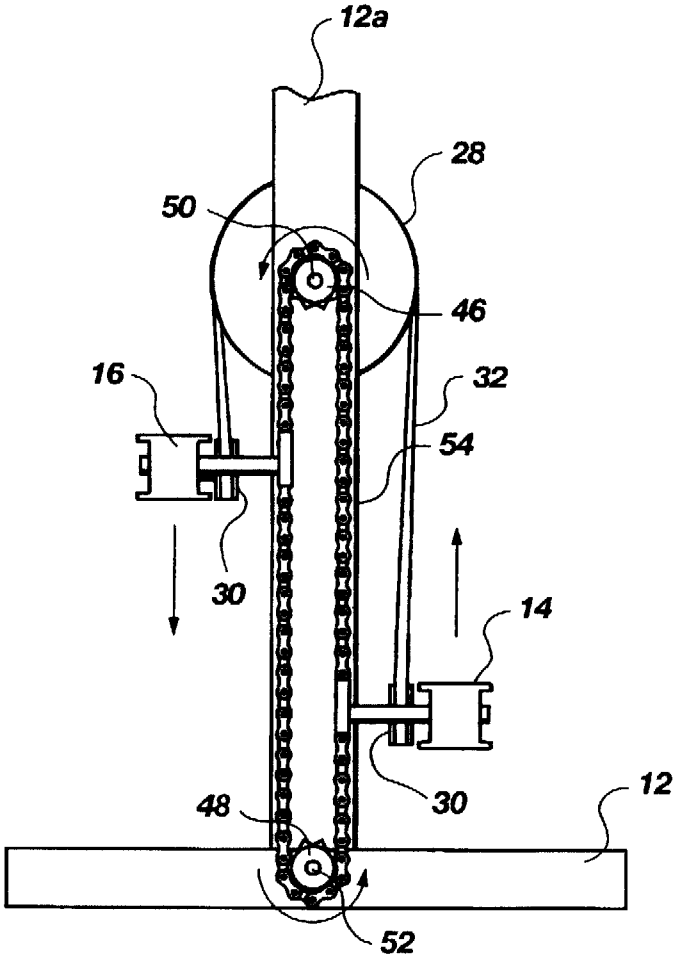
FIG. 2 is a front view of the exercise apparatus of FIG. 1.

Referring now to FIGS. 1–2, there is shown an exercise apparatus, designated generally at 10. The apparatus 10 includes a support frame 12, and first and second elonagate support members 14 and 16 pivotally mounted at first and second pivot points 18*a* and 18*b*, respectively. The pivot points 18*a* and 18*b* are preferably arranged in a substantially co-axial orientation as shown. First and second foot support means 20 and 22 are moveably disposed on the first and second support members 14 and 16, respectively. The foot support means 20 and 22 are designed for supporting a user's feet thereon and moving forwardly and backwardly lengthwise along the support members 14 and 16.

The foot support means 20 and 22 may include wheels 24 which are rollably fitted within tracks 26 formed in the support members 14 and 16. If desired, each support member 14 and 16 may include opposing tracks 26 formed on opposing sides of the support member, and each foot support means may include opposing pairs of wheels which fit rollably within the opposing tracks 26.

A central pulley 28 is rotatably mounted upon the support frame 12. Channeling pulleys 30 are rotatably mounted upon the support members 14 and 16. An endless cable 32 extends around and in engagement with the pulleys 28 and 30 such that the pulleys are confined to rotate in simultaneous rotational movement with one another. Rotational guide means 34*a* and 34*b* are mounted as desired for guiding the cable 32 along an unimpeded movement path such that the cable 32 extends lengthwise along the first and second support members 14 and 16 and is selectively movable in opposing directions along the unimpeded movement path. The rotational guide means 34*a* and 34*b* preferably comprise a plurality of pulleys which are mounted and positioned as known in the art to guide the cable 32 along an endless and unimpeded circulatory movement path. There are preferably two pulleys 34*a* rotatably mounted about the pivot points 18*a* and 18*b*.

The apparatus 10 preferably includes an axle 36 extending through the first and second pivot points 18*a* and 18*b*, such that the support members 14 and 16 are pivotally mounted about the axle 36. A support member resistive means 38 is also included for resisting pivotal movement of the support members 14 and 16 in at least one pivotal direction depicted by arcute arrow 40. The support member resistive means 38 preferably comprises a flywheel fixedly attached to the axle 36.

A unidirectional clutch means is operatively connected to each support member 14 and 16, and preferably incorporated as a part of the support members, for preventing pivotal movement of the support members relative to the axle 36 in the one rotational direction 40, such that each support member 14 and 16 is confined to pivot in tandem with simultaneous rotational movement of the axle 36 when the support member is pivotted in the one rotational direction 40. The apparatus 10 may also include unidirectional clutches for each of the pulleys 34*a*, and preferably incorporated as a part of the pulleys 34*a*, to confine rotation of the pulleys 34*a* to simultaeous rotational movement in tandem with rotation of the axle 36 in the one rotational direction 40. In this manner, the flywheel 38 provides resistance to both pivotal movement of the support members 14 and 16, and rotational movement of the pulleys 34*a*, in the one rotational direction 40. It is noted that the foot support means 20 and 22 are fixedly attached to the cable 32 at attachment points 41 and 43, respectively. The flywheel 38 thereby serves the dual purpose of a support member resistive means and a foot support resistive means since movement of the foot support means 20 and 22 is confined to movement of the cable 32 about and pulleys 34*a* which are constrained by the unidirectional clutches when rotating in the one rotational direction 40.

The apparatus 10 may also include first and second spaced-apart gears 46 and 48 rotatably disposed about first and second gear axes 50 and 52, respectively. An endless gear intercoupling means, such as a chain 54, is disposed in orbital engagement around the first and second gears 46 and 48 and attached to the first and second support members 14 and 16 at attachment points 56 and 58 for causing pivotal movement of both the first and second support members 14 and 16 to be confined to movement in tandem with simultaneous orbital movement of the chain 54 around the first and second gears 46 and 48.

The phrase "orbital engagement" as used herein shall be construed to cover the concept of a chain member such as item 54 which both engages with a gear member such as items 46 and 48 and orbits about them in a circulatory manner as the chain is advanced along its intended movement path. Accordingly, the gears 46 and 48 and the chain 54 operate as first interacting means for causing interactive movement between the support members such that pivotal movement of one of said support members in a first pivotal direction causes responsive pivotal movement of the other support member in an opposing second pivotal direction.

In use, a user may exercise with the apparatus 10 by undertaking the steps of:

(a) placing left and right feet upon the left and right foot support means 20 and 22, respectively; and (b) moving the left and right feet backwardly and forwardly in reciprocating fashion, simultaneously with moving the left and right feet upwardly and downwardly in reciprocating fashion, in a pattern such that each foot generally moves backwardly when it is moving downwardly and upwardly when it is moving forwardly, without removing the feet from the foot support means 20 and 22 and such that both foot support means remain suspended when the left and right feet are in motion.

It will be appreciated that the apparatus 10 can be utilized by a user to move both feet in a reciprocating, circular movement path, without removing the feet from the foot support means 20 and 22, such that the foot support means remain suspended when the left and right feet are in motion. Thus, the central pulley 28, pulleys 30, 34*a* and 34*b*, and the cable 32 collectively comprise both a means for enabling the foot support means 20 and 22 to move (i) simultaneously backwardly and downwardly and (ii) simultaneously forwardly and upwardly, in a reciprocating movement path, and a first interacting means for causing interactive movement between the support members 14 and 16 such that pivotal movement of one of the support members in a first pivotal direction causes responsive pivotal movement of the other support member in an opposing second pivotal direction.

The gears 46 and 48, together with the chain 54, can also be referred to as a first interacting means for causing interactive movement between the support members 14 and 16 such that pivotal movement of one of the support members in a first pivotal direction causes responsive pivotal movement of the other support member in an opposing second pivotal direction. To that extent, the gears 46 and 48 and chain 54 are somewhat redundant of the function accomplished by the cable 32 and associated pulleys. However, despite the seeming redundancy, the gears 46 and 48 and chain 54 provide additional stability to the workings of the apparatus 10. If desired, the gears 46 and 48 and the chain 54 could be manipulated in an appropriate manner known to those skilled in the art to provide resistance to pivotal movement of the support members 14 and 16.

In a broader sence, the cable 32 and associated pulleys 30, 34*a* and 34*b* collectively constitute a moving means connected to the support members 14 and 16 for pivotally moving the support members about their pivot points 18*a* and 18*b* from a first position to a second position. Similarly, the gears 46 and 48 and associated chain 54 also constitute moving means connected to the support members 14 and 16 for pivotally moving said support members about their pivot points 18*a* and 18*b* from a first position to a second position.

It will be appreciated that numerous alternative embodiments of the apparatus 10 can be made in accordance with the principles of the present invention. A few such alternatives are illustrated in FIGS. 3–12. Since some of the structural elements of the apparatus 10 of FIG. 1 are represented identically in the alternative embodiments of FIGS. 2–12, these like structures will be represented with like reference numerals. Different reference numerals will of course be utilized to designate all other structural elements.

It will be appreciated by those of ordinary skill in the art that the ratio of forward/backward movement of the foot support means 20 and 22 to upward/downward movement of the support members 14 and 16 can be adjusted by replacing the central pulley 28 with another pulley of different size.

Figure 3:
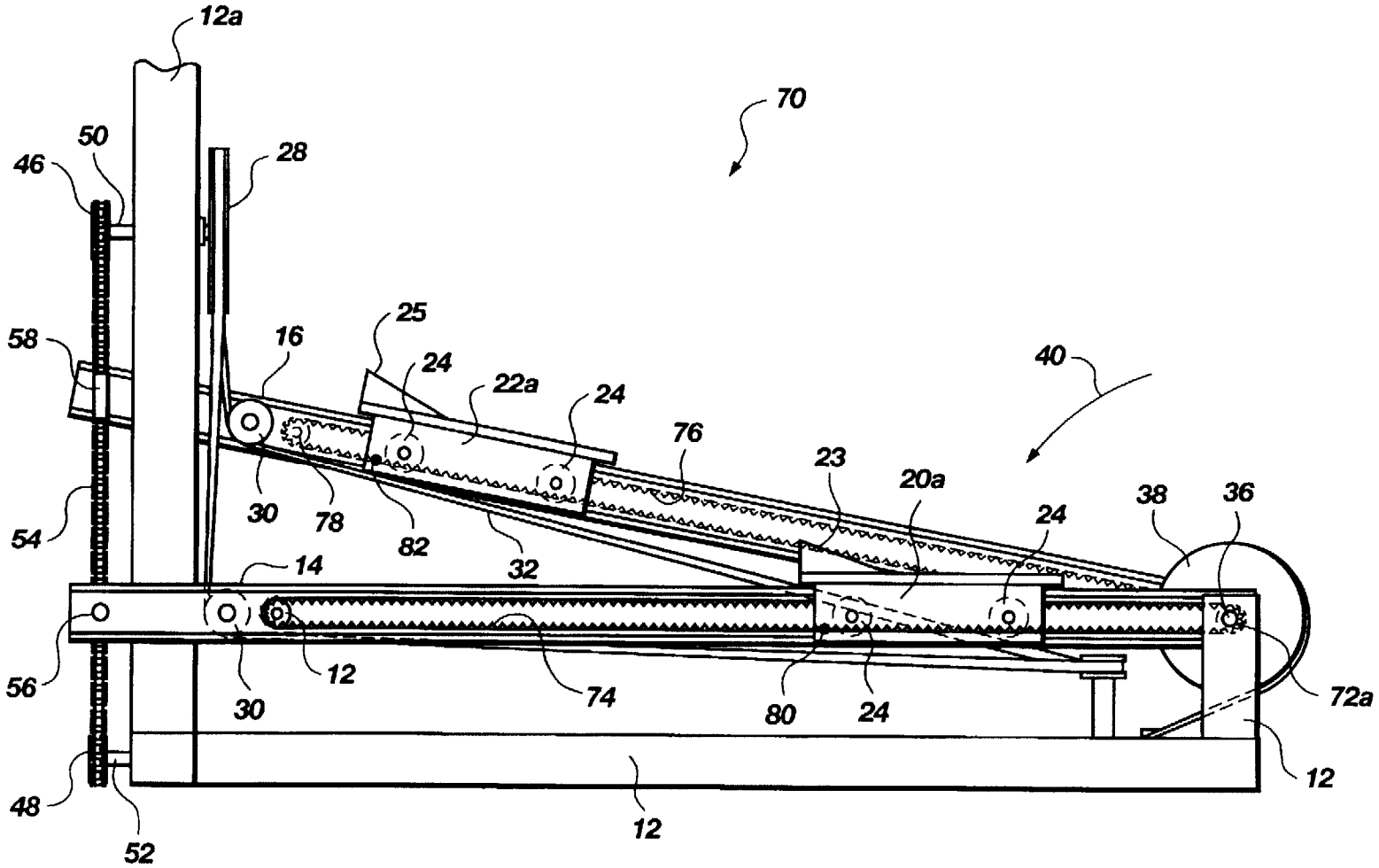
FIG. 3 is a side view of an alternative embodiment of the exercise apparatus of FIG. 1.

Referring now to FIG. 3, there is shown an alternative embodiment of the invention, in the form of an exercise apparatus designated generally at 70. The apparatus 70 includes resistance pulleys 72*a* rotatably disposed about the axle 36. The first and second foot support means are designated as 20*a* and 22*a*, respectively, to signify that they are not attached to the cable 32 as opposed to the embodiment illustrated in FIG. 1. There are preferably two resistance pulleys 72*a* rotatably mounted about the axle 36 to correspond to the first and second foot support means 20*a* and 22*a*.

First and second endless cable members 74 and 76 extend around the first and second resistance pulleys 72*a*, respectively, and in engagement therewith, such that each cable member 74 and 76 is confined to orbit about the axle 36 in tandem with simultaneous rotational movement of the resistance pulley 72*a* about which the cable member extends. The foot support means 20*a* and 22*a* are attached to the cable members 74 and 76, respectively, preferably at attachment points 80 and 82.

A unidirectional clutch means is operatively connected to each resistance pulley 72*a*, and preferably incorporated as a part of the resistance pulleys 72*a*, for preventing rotational movement of the resistance pulleys 72*a* relative to the axle 36 in one rotational direction, preferably in direction 40, such that each resistance pulley 72*a* is confined to rotate in tandem with simultaneous rotational movement of the axle 36 when the resistance pulley 72*a* is rotating in the one rotational direction 40. Rotational guide means 78 are provided for guiding the cable members 74 and 76 along respectively unimpeded movement paths to thereby enable the cable members to convey resistance from the flywheel 38 to the foot support means 20*a* and 22*a* when the first and second resistance pulleys 72*a* rotate in the one rotational direction 40, so that the flywheel 38 provides resistance to both (i) movement of the foot support means 20*a* and 22*a* with respect to the support members 14 and 16, and (ii) pivotal movement of the support members 14 and 16.

Accordingly, the cable members 74, 76 and the resistance pulleys 72*a* constitute foot support resistive means for resisting movement of the foot support means 20*a*, 22*a* in at least one direction relative to the support members. It will be appreciated from the description above that movement of each foot support means 20*a*, 22*a* in a backwardly direction toward the flywheel 38 is resisted by the flywheel 38 from operation of the unidirectional clutches in association with the resistance pulleys 72*a*. In contrast, movement of the foot support means 20*a* and 22*a* in a forwardly direction toward the support post 12*a* of the frame 12 is not resisted by the flywheel 38 because rotational movement of the pulleys 72*a* in the direction opposite 40 is released with respect to the axle 36.

The cable members 74 and 76 can be described as intercoupling means extending around the axle 36 so as to be moveable in orbital movement about the axle 36, such that movement of said foot support means with respect to the support member on which said foot support means is disposed is confined to movement in tandem with orbital movement of the intercoupling means about the axle 36.

The resistance pulleys 72*a* preferably comprise gear members having gear teeth as shown, and the cable members 74 and 76 preferably comprise cogged belt members having teeth which are configured and spaced to correspond to the teeth spacing on the gear members 72*a*.

Figure 4:
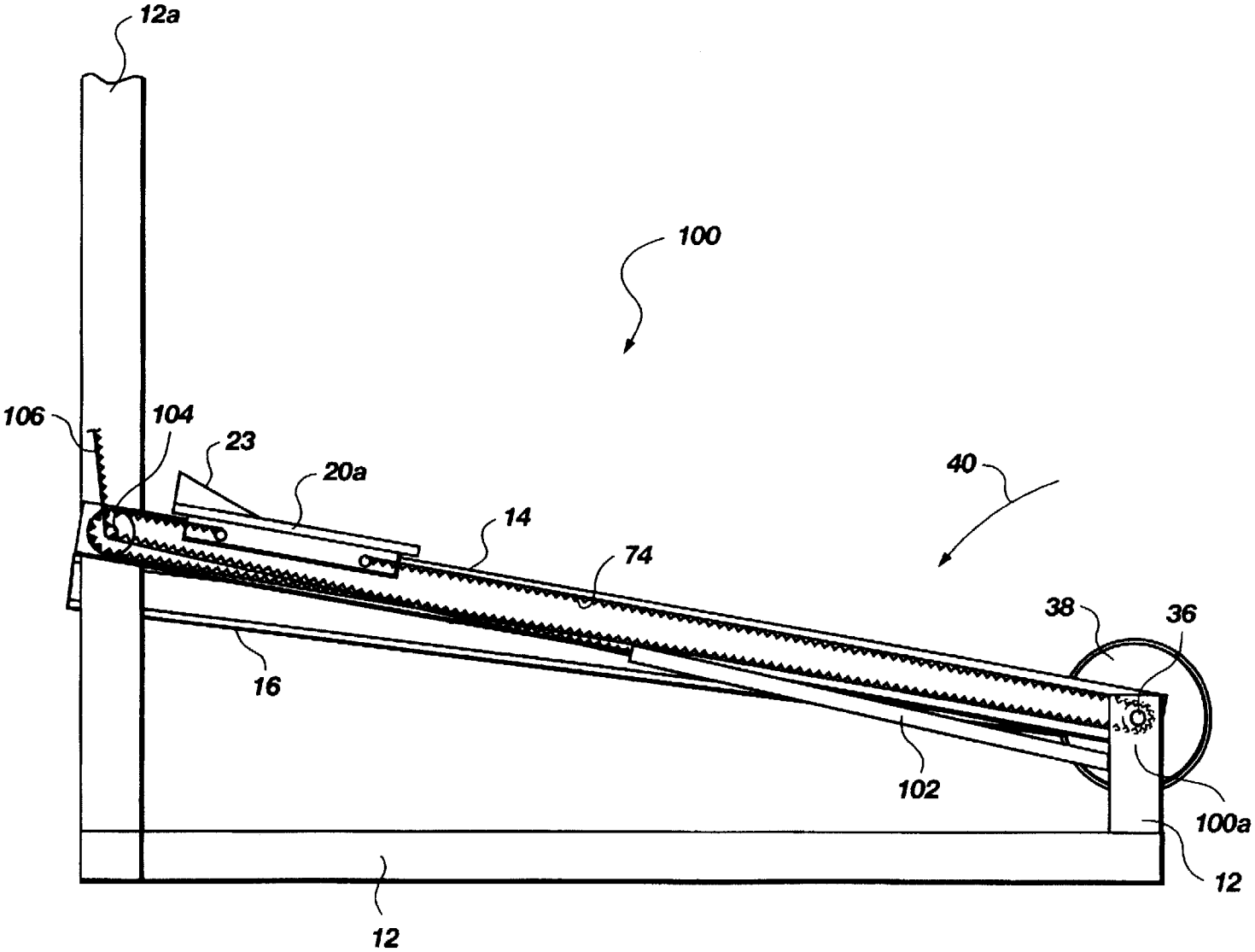
FIG. 4 is a side view of another alternative embodiment of the exercise apparatus of FIG. 1.

Referring now to FIG. 4, there is shown an alternative embodiment of the invention, in the form of an exercise apparatus designated generally at 100. The apparatus 100 includes resistance gears 100*a* for each of the cogged belts 74 and 76 (not shown in FIG. 4) with an incorporated unidirectional clutch as described above.

The moving means connected to the support members 14 and 16 for pivotally moving the support members about their pivot points from a first position to a second position is embodied by different structural elements. Essentially, an elastomeric member 102 intercouples the first support member 14 with the support frame 12 for resisting downward pivotal movement of the support member 14. A gear member 104 is rotatably disposed in a supported position, preferably upon the first support member 14 as shown. An intercoupling member 106 is attached to the support post 12*a* at a location residing above the first support member 14. The intercoupling member 106 extends downwardly around and beneath the gear member 104 in engagement therewith, and from the gear member into attachment with the elastomeric member 102. The intercoupling member 106 is preferably a cogged belt configured and arranged for being meshably engaged with the gear 104, and is sufficiently short to hold the support member 14 in a suspended position An identical elastomeric member, gear and cogged intercoupling belt (not shown) are provided in conjunction with the second support member 16. When a user mounts the apparatus 100 and applies downward pressure to one of the foot support means 20*a* or 22*a* (not shown in FIG. 4), the associated support member 14 or 16 is pivotted downwardly against the resistance of the elastomeric member 102, which expands responsively. When the pressure is reduced, elastic memory in the elastomeric member 102 operates to contract the member 102 and thereby lift the support member 14 pivotally upwardly against rotational movement of the gear 104, as my be understood by inspection of FIG. 4.

In accordance with the description provided above, it will be understood that downward movement of the gears 104 against the intercoupling members 106 causes responsive tensile stretching in the elastomeric material 102 for resisting downward pivotal movement of the support members 14 and 16. The elastomeric material 102 has elastic memory sufficient to cause contraction of the material for forcing upward pivotal movement of the support members 14 and 16.

It will be understood that the apparatus 100 of FIG. 4 may also utilize the flywheel 38 to provide resistance to pivotal movement of the support members 14 and 16, in addition to the resistance provided by the elastomeric members 102.

Altneratively, unidirectional clutches could be utilized only as part of the resistance gears 100*a* but in a direction opposite that described in conjunction with FIG. 3. As such, the flywheel 38 of FIG. 4 would be caused to rotate in a rotational direction opposite the direction 40, and the foot support means 20*a* and 22*a* (not shown in FIG. 4) would be attached to the top of the cogged belts 74 and 76 (not shown in FIG. 4) instead of to the bottom as in FIG. 3.

Figure 5:
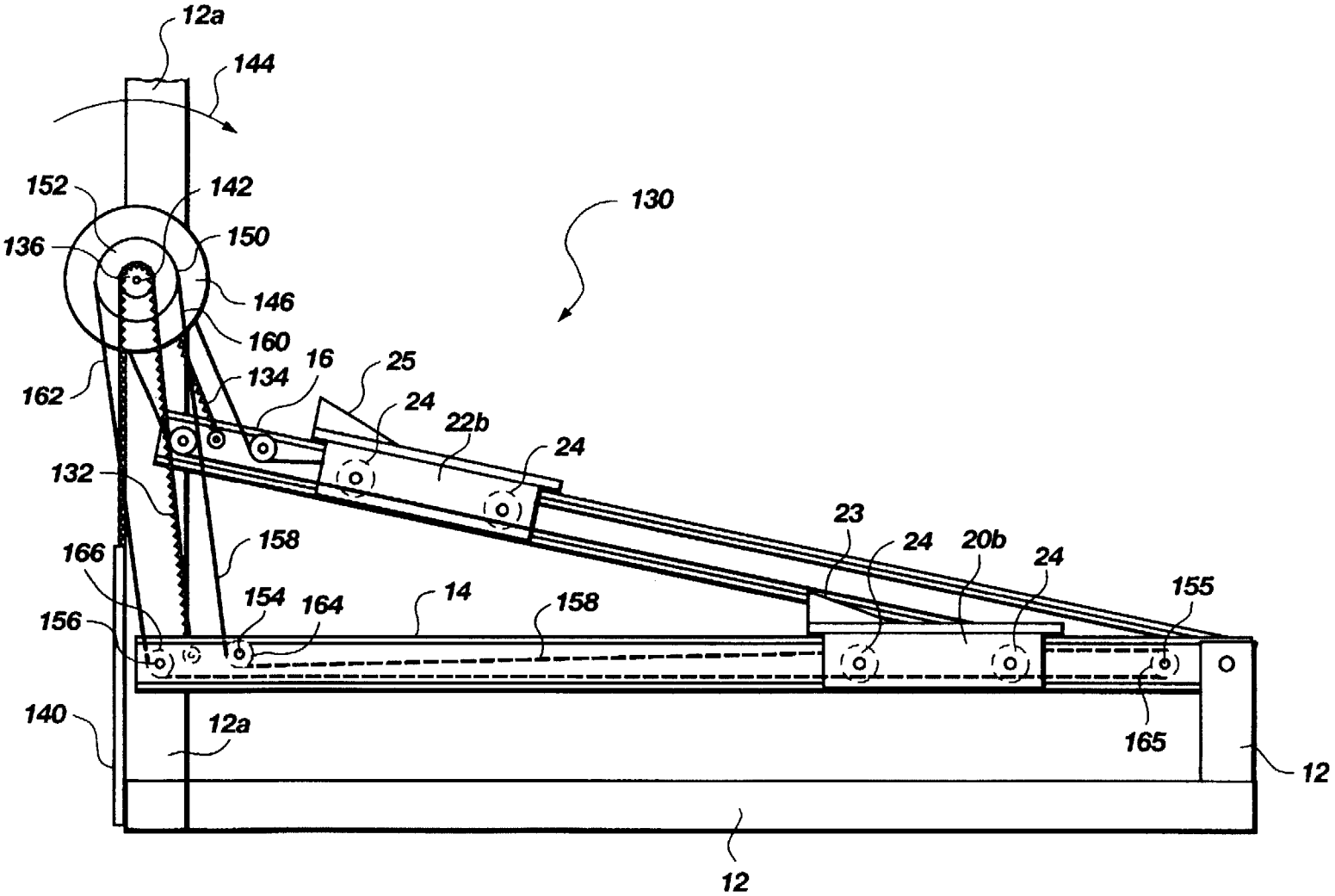
FIG. 5 is a side view of still another alternative embodiment of the exercise apparatus of FIG. 1.

Referring now to FIG. 5, there is shown an exercise apparatus, designated generally at 130. Intercoupling means 132 and 134 are attached to the first and second support members 14 and 16, respectively. The intercoupling means 132 and 134 extend from the support members around and in engagement with first and second gear members 136, and into attachment with first and second elastomeric members 140. The intercoupling means 134 and 136 preferably comprise cogged belt members disposed in meshing engagement with the gears 136. As such, the first intercoupling means 132 is confined to orbit about the first gear member 136 in tandem with simultaneous rotational movement of that gear member, and the second intercoupling means 136 is confined to orbit about the second gear member in tandem with simultaneous rotational movement of that second gear member. It can be seen than downward pivotal movement of the first support member 14 is resisted by the elasticity of the elastomeric member 140, and similar resistance is provided to downwardly pivotal movement of the second support member 16 by a like elastomeric member.

An axle 142 is rotatably supported on the support frame 12, such as the support post 12*a*, and the gears 136 are rotatably disposed about the axle 142. Optional additional resistance to downwardly pivotal movement of the support members 14 and 16 can be provided by provision of unidirectional clutches in conjunction with the gears 136. By illustrative reference to the first support member 14 and gear 136, the unidirectional clutch would operate to fixedly attach the gear 136 to the axle 142 when that gear is rotated in a first rotational direction 144, and release the gear 136 when it is rotated in an opposing second rotational direction. As such, the gear 136 and axle 142 are confined to simultaneous rotational movement with one another in the first rotational direction 144. Attachment of a flywheel 146 upon the axle 142 would provide the optional additional resistance to downward pivotal movement of the support members.

Additional stability and resistance can be provided by provision of first and second reels rotatably disposed on the axle 142. First and second reels 150 and 152 are shown in FIG. 5 in conjunction with the workings of the first support member 14, with the understanding that a like pair of reels are provided in conjunction with the second support member 16. First, second and third guide axles 154, 155 and 156 are disposed on the first support member 14. A cable member 158 has a first end 160 wound about the first reel 150 in a first winding direction and an opposing second end 162 wound about the second reel 152 in an opposing second winding direction. The cable member 158 extends from the first reel 150 sequentially around the first, second and third guide axles 154, 155 and 156 to the second reel 152. The first foot support means 22*b* resides between the first and second guide axles 154 and 155 and is fixedly attached to the cable member 158.

When the first support member 14 is pivotted downwardly, the first and second ends 160 and 162 of the cable 158 are pulled out of the reels 150 and 152. The reels 150 and 152 are thus rotationable disposed about the axle 142. Additional resistance may be provided by coupling the reels 150 and 152 to the flywheel 146 somehow. For example, an engagement means could be provided for engaging the first and second reels 150 and 152 to the gear 136 such that rotational movement of the gear 136 causes rotational movement of the first and second reels 150 and 152 when the first support member 14 is pivotted downwardly. The reels 150 and 152 could alternatively be rotatably disposed about the axle 142 but without connection to the gear 136 and include retraction means for automatically retracting the cable ends and reeling them in when downwardly pressure upon the first support member 14 is reduced.

Preferably, pulleys 164, 165 and 166 are disposed about the guide axles 154, 155 and 156 to operate and rotational guide means for guiding the cable 158 along an unimpeded circulatory movement path responsive to pivotal movement of the first support member 14.

Figure 6:
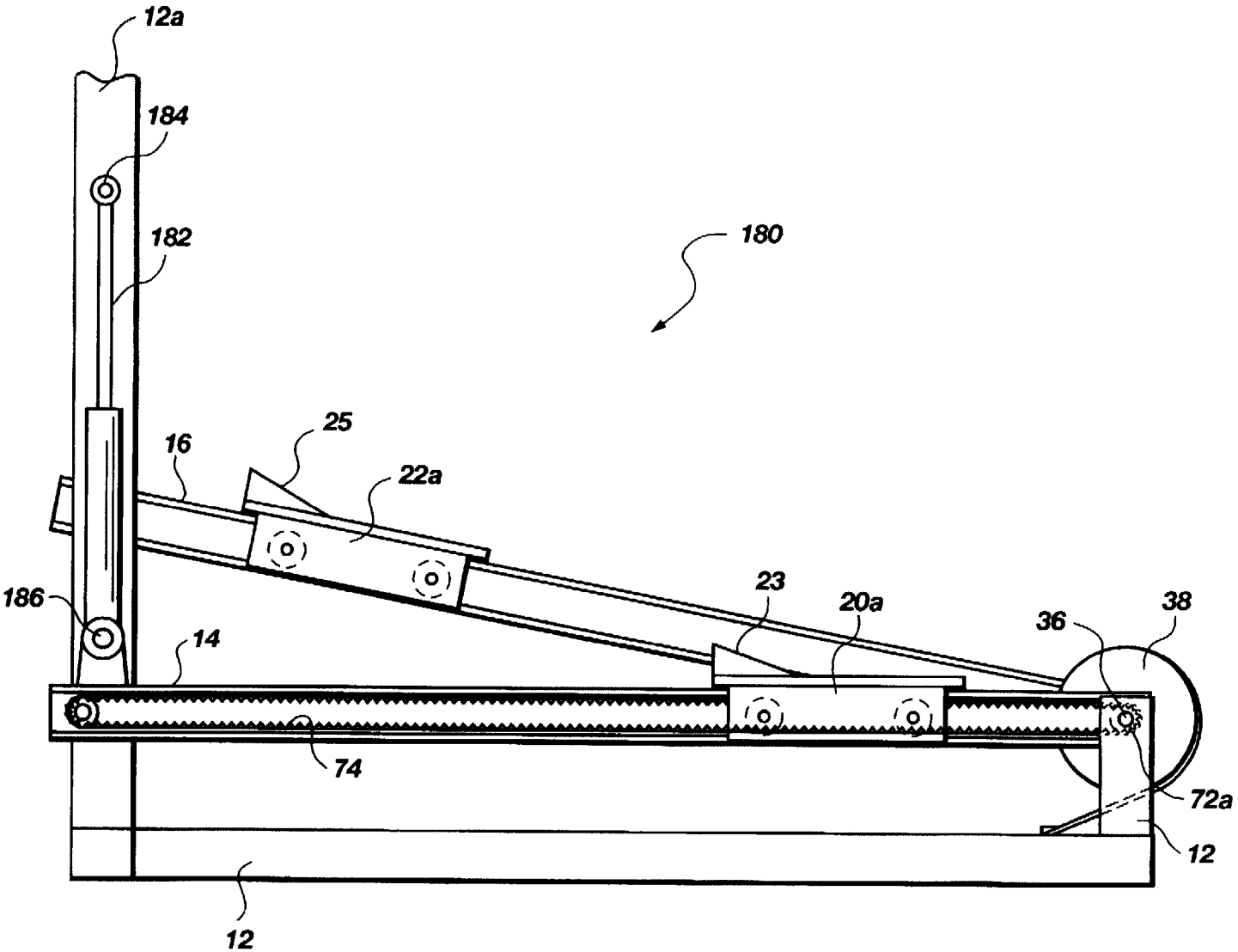
FIG. 6 is a side view of yet another alternative embodiment of the exercise apparatus of FIG. 1.

Referring now to FIG. 6, there is shown an exercise apparatus, designated generally at 180. In this embodiment, the moving means for pivotally moving the support members 14 and 16 about their pivot points from a first position to a second position, and the support the support member resistive means, collectively comprise first and second pneumatic cylinders intercoupling the first and second support members with the support frame 12. By illustration, first pneumatic cylinder 182 is shown pivotally attached to the frame post 12*a* at pivot connection 184, and pivotally attached to the first support member 14 at pivot connection 186. The pneumatic cylinder 182 operates to retract as known in the art to pull the first support member 14 pivotally upwardly upon reduction of a downward force upon the first support member 14.

Figure 7:
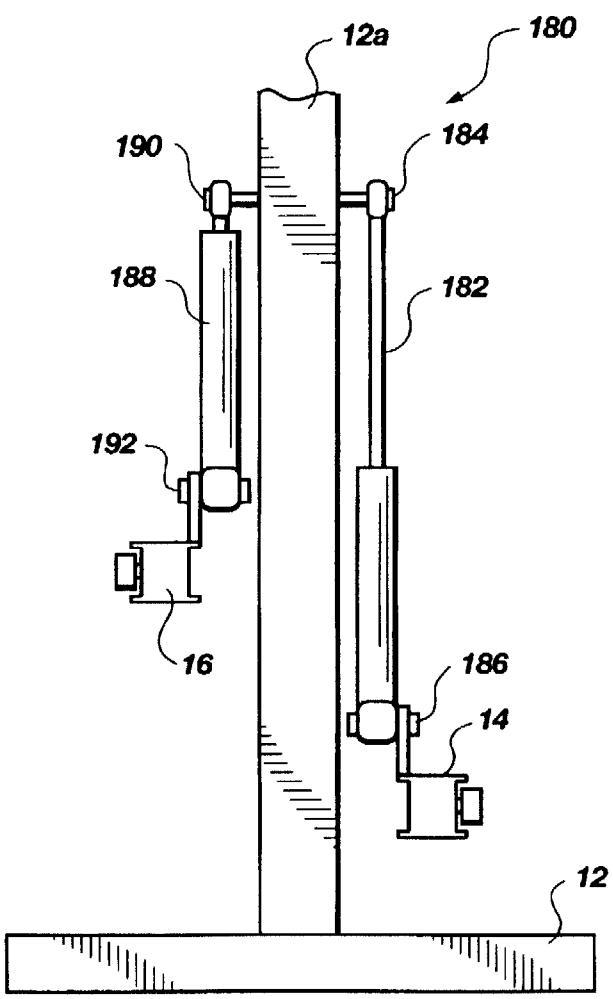
FIG. 7 is a front view of the exercise apparatus of FIG. 6.

Referring now to FIG. 7, there is shown a front view of the apparatus 180 of FIG. 6. A second pneumatic cylinder 188 is shown pivotally connected to the support frame post 12*a* at pivotal connection 190, and to the second support member 16 at pivotal connection 192.

Figure 8:
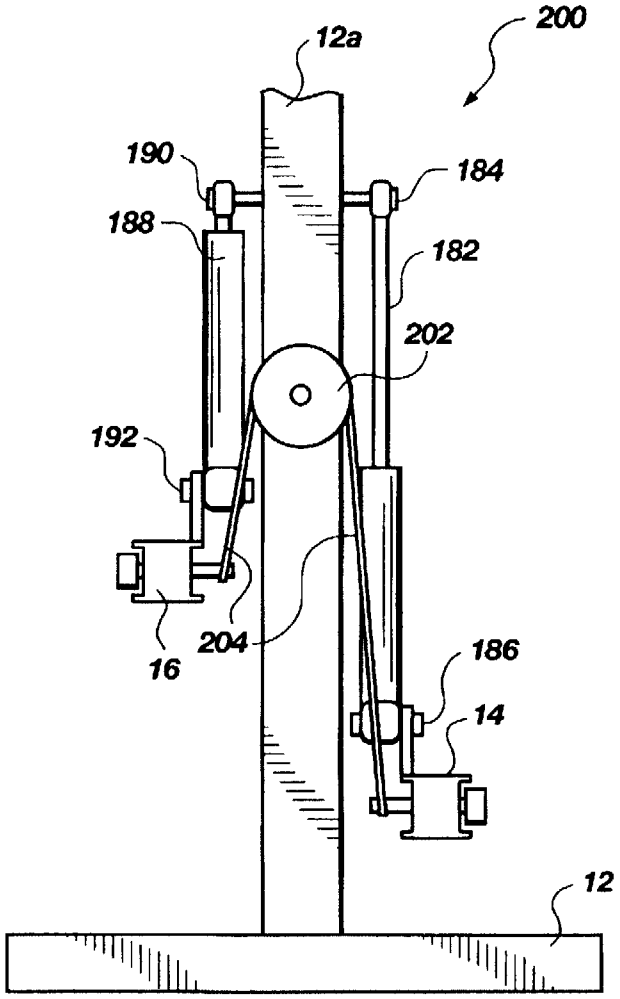
FIG. 8 is a side view of an alternative embodiment of the exercise apparatus of FIGS. 6–7.

Referring now to FIG. 8, there is shown an alternative embodiment of the exercise apparatus 180, designated generally at 200. The principal difference between the exercise apparatus 200 of FIG. 8, as compared to the exercise apparatus 180 of FIGS. 6–7, is the provision of central pulley/gear 202 and associated intercoupling cable 204. The central pulley/gear 202 is rotatably mounted upon the support frame post 12*a*, preferably such that the first and second support members 14 and 16 reside on opposing sides of the central pulley/gear 202, respectively. The cable 204 is disposed in engagement around the central pulley/gear 202 for intercoupling the first and second support members 14 and 16. As such, it will be appreciated that the central pulley/gear 202 and associated cable 204 functions as afirst interacting means for causing interactive movement between the support members 14 and 16 such that pivotal movement of one of the support members in a first pivotal direction causes responsive pivotal movement of the other support member in an opposing second pivotal direction.

Figure 9:
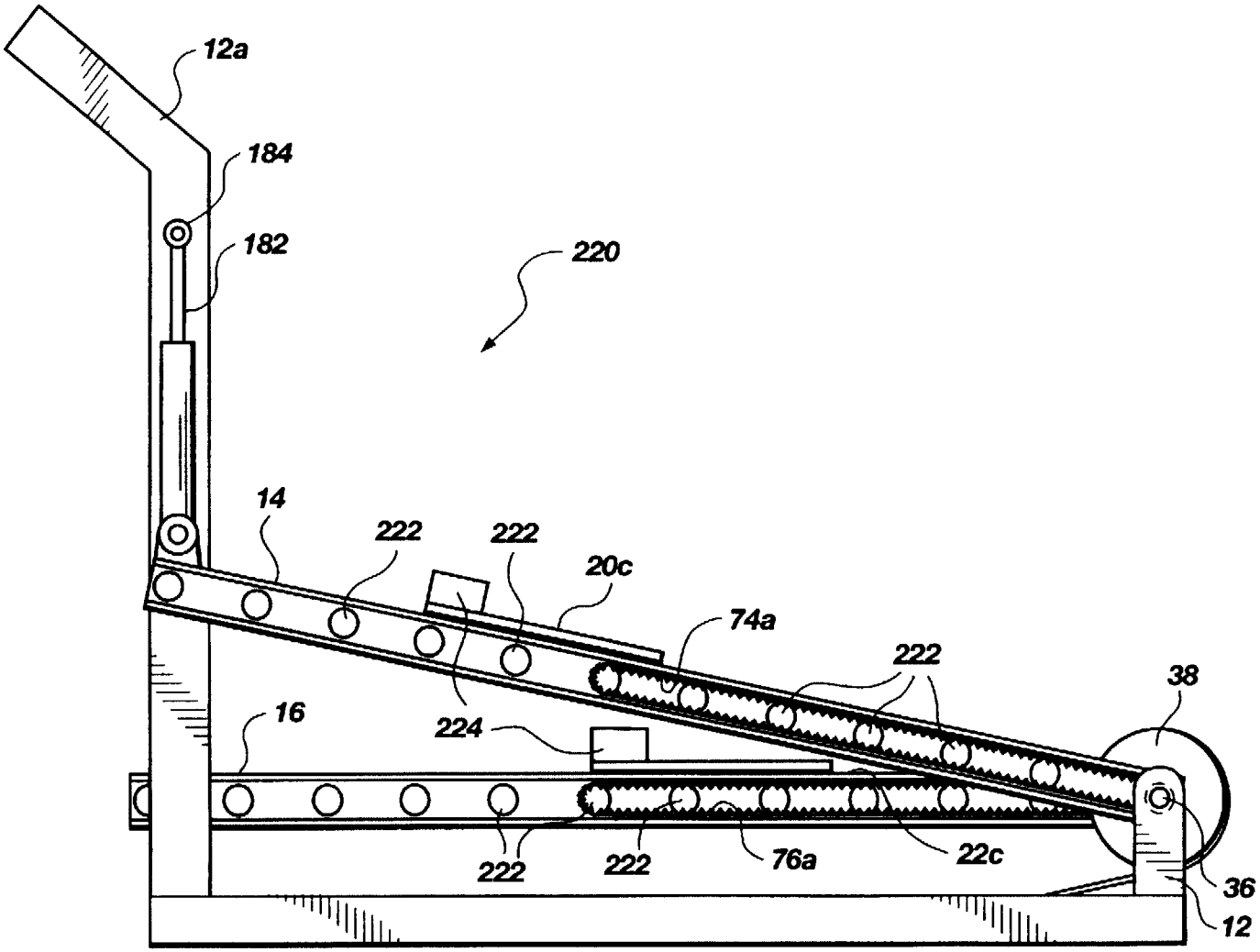
FIG. 9 is a side view of a further alternative embodiment of the exercise apparatus of FIG. 1.

Referring now to FIG. 9, there is shown an exercise apparatus, designated generally at 220. The cogged belts 74*a* and 76*a* are disposed among roller means 222 rotatably disposed on the support members 14 and 16 for rollably supporting the foot support means 20*c* and 22*c* thereon. In the embodiment of FIG. 9, the foot support means comprise elongate ski members having toe grips 224 thereon.

Figure 10:
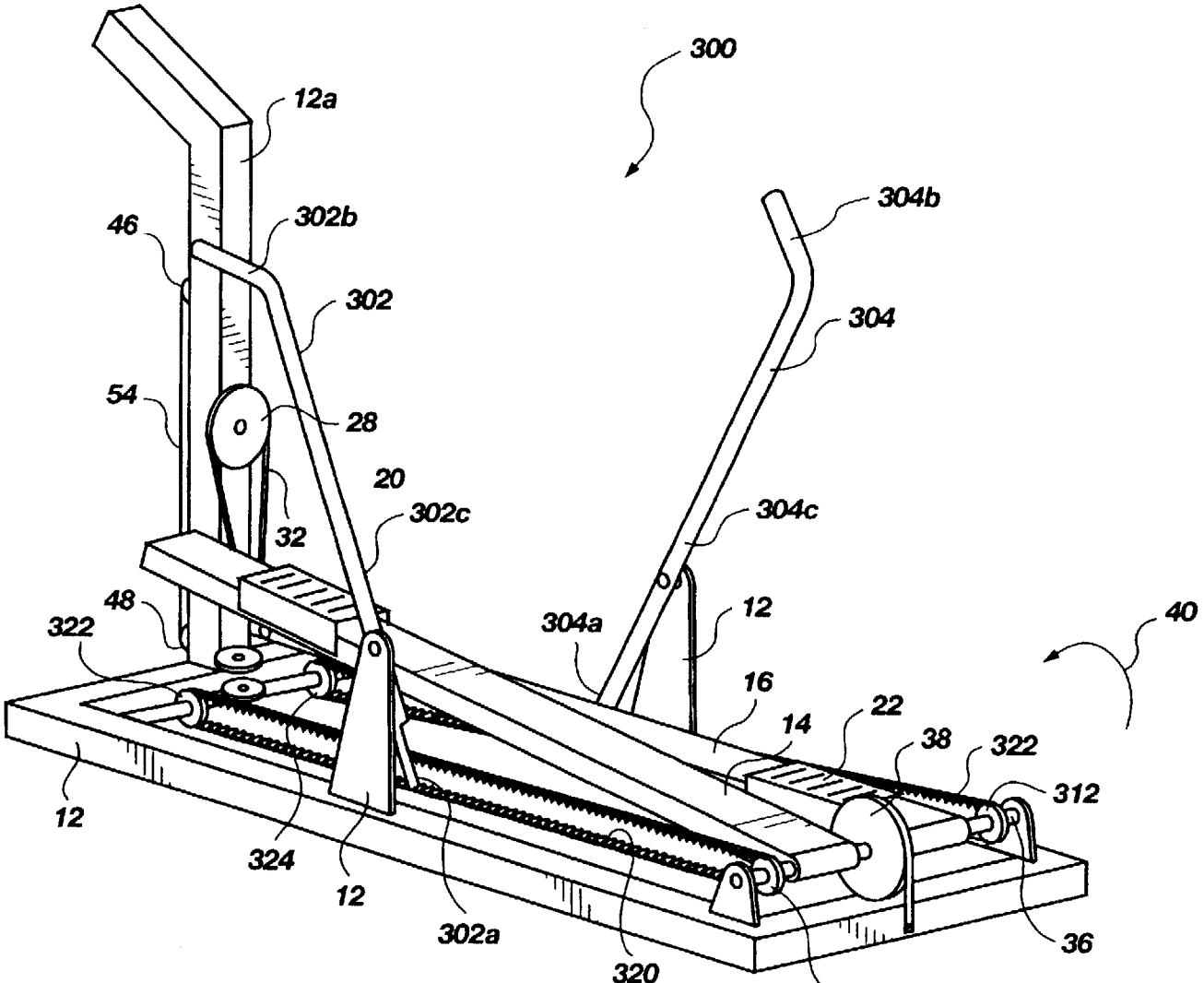
FIG. 10 is a perspective view of an additional alternative embodiment of the exercise apparatus of FIG. 1.

Referring now to FIG. 10, there is shown an exercise apparatus, designated generally at 300. The apparatus 300 is substantially identical to the apparatus 10 illustrated in FIGS. 1–2. The principal difference is the addition of first and second upwardly-extending hand grips 302 and 304.

Hand grip 302 has an intermediate portion 302*c* and opposing proximal and distal portions 302*a* and 302*b*, respectively, and hand grip 304 has an intermediate portion 304*c* and opposing proximal and distal portions 304*a* and 304*b*, respectively.

Each hand grip 302 and 304 is pivotally mounted to the support frame 12 at their intermediate portions 302*c* and 304*c*. The hand grips are disposed on opposing sides of the support members 14 and 16. Hand grip resistive means are included for resisting pivotal movement of the hand grips 302 and 304. The hand grip resistive means preferably comprises first and second hand grip gears 310 and 312 rotatably disposed about the axle 36, and unidirectional clutch means for preventing rotational movement of the hand grip gears 310 and 312 relative to the axle 36 in the one rotational direction 40 such that each hand grip gear 310 and 312 is confined to rotate in tandem with simultaneous rotational movement of the axle 36 when the hand grip gear is rotating in the one rotational direction 40.

First and second intercoupling means 320 and 322 are attached to the hand grips 302 and 304, respectively, and extend around the hand grip gears 310 and 312 and in engagement therewith for intercoupling the hand grip gears to the hand grips such that the intercoupling means 320 and 322 are confined to orbit about the axle 36 in tandem with simultaneous rotational movement of the hand grip gears 310 and 312. The first and second intercoupling means 320 and 322 are preferably cogged belt means disposed in meshing engagement with the hand grip gears 310 and 312. Rotational guide means 322 and 324 are provided for guiding the intercoupling means 320 and 322 along unimpeded movement paths to thereby enable the intercoupling means to convey resistance from the flywheel 38 to the hand grips 302 and 304 when the hand grip gears 310 and 312 are rotating in the one rotational direction 40, so that the flywheel 38 provides resistance to both (i) pivotal movement of the hand grips 302 and 304 and (ii) pivotal movement of the support members 14 and 16.

It will be appreciated from inspection of the apparatus 300 in FIG. 10 that the unidirectional clutches operate to enable the flywheel 38 to provide resistance to: (i) pivotal movement of the support members 14 and 16; (ii) movement of the foot support means 20 and 22 along the support members 14 and 16; and (iii) pivotal movement of the hand grips 302 and 304.

Figure 11:
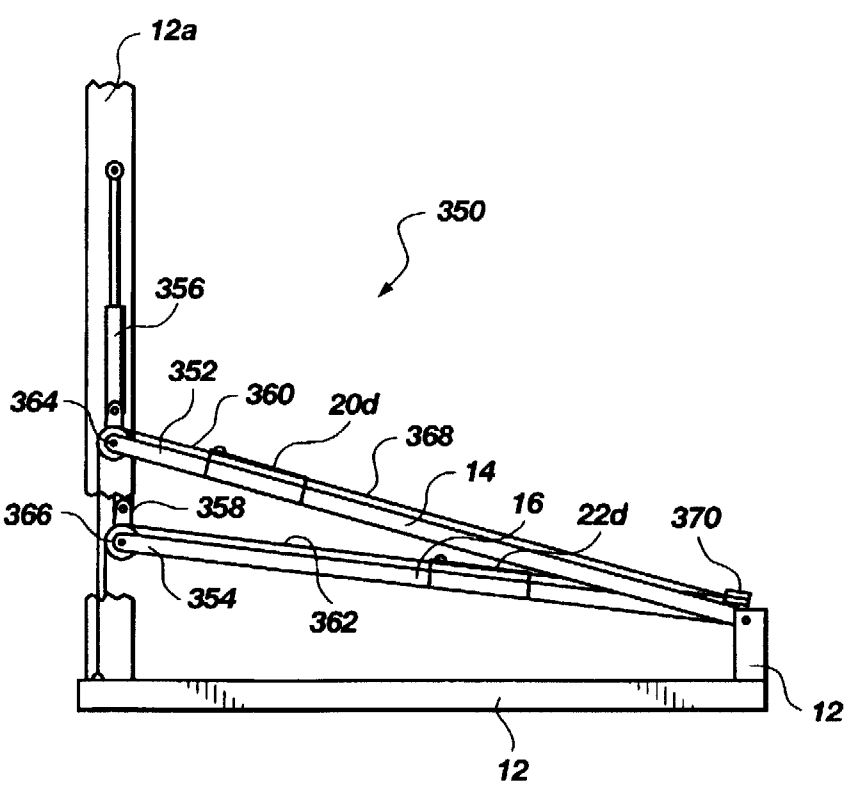
FIG. 11 is a side view of another alternative embodiment of the exercise apparatus of FIG. 1.

Referring now to FIG. 11, there is shown an exercise apparatus, designated generally at 350. The first and second support members 14 and 16 each include end sections 352 and 354, respectively. First and second expansion/retraction means 356 and 358 are disposed to intercouple the end sections 352 and 354 with the support frame post 12*a* for expandably resisting downward pivotal movement of support members 14 and 16 responsive to force imposed upon the support members, and retractably moving the support members upwardly responsive to removal of said force. The first and second expansion/retraction means 356 and 358 are preferably pneumatic cylinders.

The foot support resistive means comprise cable members 360 and 362 attached to the first and second foot support means 20*d* and 22*d* and extending therefrom around the end sections 352 and 354, respectively of the support members 14 and 16 and downwardly into attachment with the support frame 12. It will be appreciated by inspection of FIG. 11 that backward movement of the foot support means 20*d* and 22*d* along the support members 14 and 16 is resisted by the expansion/retraction means 356 and 358.

The apparatus 350 preferably comprises end gears 364 and 366 rotatably disposed on the end sections 352 and 354 of the support members. The end gears 364 and 366 are preferably pulleys. Additional interactive resistance can be provided by a third cable member 368 intercoupling the first and second foot support means 20*d* and 22*d*. Rotational guide means, preferably in the form of one or more pulleys 370, are provided for guiding the third cable member 368 along an unimpeded movement path such that movement of one of the foot support means toward the end section of the support member on which said foot support means is disposed operates to pull the other foot support means in tandem therewith in a direction away from the end section of the support member on which said other foot support means is disposed.

Figure 12:
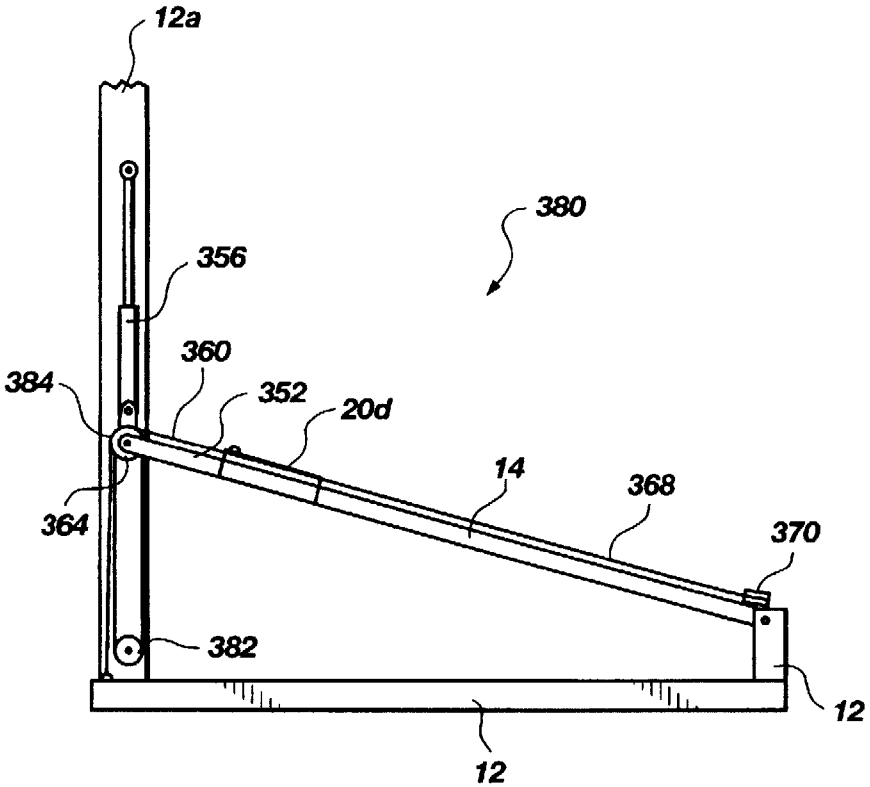
FIG. 12 is a side view of an alternative embodiment of the exercise apparatus of FIG. 11.

Referring now to FIG. 12, there is shown an alternative design of the exercise apparatus 350 of FIG. 11, designated generally at 380. A channeling gear 382 is rotatably disposed on the support frame 12. The first cable member 360 extends along a sequential path from the first foot support means 20*d* sequentially (i) around the end gear 364 and in engagement therewith, (ii) downwardly to the channeling gear 382, (iii) around said channeling gear 382 and in engagement therewith, and (iv) from said channeling gear 382 into attachment with the support frame 12.

As shown in FIG. 12, this arrangement is preferably accomplished by the addition of a second end gear 384 rotatably disposed upon the end section 352 of the first support member 14, wherein element (iv) of the sequential path of the first cable member 360 further comprises the first cable member 360 extending (v) from the channeling gear 382 upwardly to the second end gear 384, (vi) around said second end gear 384 and in engagement therewith, and (vii) downwardly into attachment with the support frame 12. The double-loop effect of the additional gears 382 and 384 provides additional length for the first cable 360 if such is needed to provide more backword travel distance for the first foot support means 20*d*.

It will be understood than any pulley or gear member described herein may be selected from the group consisting of:

a pulley;

a sprocket; and a toothed gear member;

It will also be understood than any cable or belt member described herein may be selected from the group consisting of:

an endless cable member engageable with a pulley; and an endless chain member comprising a plurality of interconnected links which are engageable with a gear selected from the group consisting of:

a sprocket; and a toothed gear member.

It is preferred that the first and second foot support means 20 and 22 be mounted upon the top surfaces of the first and second support members 14 and 16, respectively, as shown throughout the drawings. It is also preferred that the the first and second pivot points 18*a* and 18*b* be common to single axis as shown. It is further preferred that the first and second foot support means 20 and 22 be substantially rigid and nonflexible, and that they have upper surfaces 23 and 25 which define acute angles with respect to the first and second support members 14 and 16, respectively.

In accordance with the disclosure set forth above, a preferred method for exercising compises the steps of:

(a) placing left and right foot support means in movable suspension;

(b) placing left and right feet upon said left and right foot support means, respectively; and (c) moving the left and right feet backwardly and forwardly in reciprocating fashion, simultaneously with moving said left and right feet upwardly and downwardly in reciprocating fashion, in a pattern such that each foot generally moves backwardly when it is moving downwardly and upwardly when it is moving forwardly, without removing the feet from the foot support means and such that said foot support means remain suspended when the left and right feet are in motion.

Step (c) above may include moving each foot in a reciprocating circular movement path without removing the feet from the foot support means. It will be appreciated that the overall combination of movement of the various exercise apparatus disclosed in the drawings operates to accomplish a circular movement path of the feet.

It is to be understood that the above-described arrangements are only illustrative of the application of the principles of the present invention. Numerous modifications and alternative arrangements may be devised by those skilled in the art without departing from the spirit and scope of the present invention. For example, the reels 150 and 152 of FIG. 5 can be designed and implemented in any manner known to those or ordinary skill in the art to accomplish stability and resistance to the upward and downward pivotal movement of the support member 14, regardless of how the reels are attached to the axle 142. Further, the specific direction of any of the unidirectional clutches discussed herein may be arranged in any suitable manner to accomplish whatever directional resistance is desired. The appended claims are intended to cover these and any other modifications and arrangements which may be achieved by those having oridinary skill in the art.

What is claimed is:

1. An exercise apparatus comprising:

first and second elongate support members being pivotally mounted at first and second pivot points, respectively;

first and second foot support means moveably disposed on the first and second support members, respectively, for supporting a user's feet thereon and moving forwardly and backwardly with respect to the support members while the user's feet are disposed thereon;

moving means connected to the support members for pivotally moving said support members about their pivot points from a first position to a second position; and wherein the moving means comprises first interacting means for causing interactive movement between the support members such that pivotal movement of one of said support members in a first pivotal direction causes responsive pivotal movement of the other support member in an opposing second pivotal direction and further comprises interactive means causing reciprocating movement of the foot support means with respect to the support members that is interconnected with the first interacting means to cause reciprocating movement of the pivoting support members, wherein the forward and backward movement of the foot support means and pivoting movement of the support members are dependent on each other.

2. An exercise apparatus comprising:

first and second elongate support members being pivotally mounted at first and second pivot points, respectively;

support member resistive means for resisting pivotal movement of the support members in at least one pivotal direction;

first and second foot support means moveably disposed on the first and second support members, respectively, for supporting a user's feet thereon and moving forwardly and backwardly with respect to the support members; and an axle extending through the first and second pivot points, wherein the support members are pivotally mounted about the axle;

wherein the support member resistive means comprises a flywheel attached to the axle, and unidirectional clutch means for preventing pivotal movement of the support members relative to the axle in one rotational direction such that each support member is confined to pivot in tandem with simultaneous rotational movement of the axle when said support member is pivoted in said one rotational direction.

3. The exercise apparatus as defined in claim 2, further comprising foot support resistive means for resisting movement of the foot support means in at least one direction relative to the support members.

4. The exercise apparatus as defined in claim 3, wherein the foot support resistive means comprises:

first and second resistance pulleys rotatably disposed about the axle;

unidirectional clutch means for preventing rotational movement of the resistance pulleys relative to the axle in said one rotational direction such that each resistance pulley is confined to rotate in tandem with simultaneous rotational movement of the axle when said resistance pulley is rotating in said one rotational direction;

first and second endless cable members extending around the first and second resistance pulleys, respectively, and in engagement therewith, such that each cable member is confined to orbit about the axle in tandem with simultaneous rotational movement of the resistance pulley about which said cable member extends, wherein the foot support members are attached to the cable member; and rotational guide means for guiding the cable members along respectively unimpeded movement paths to thereby enable the cable members to convey resistance from the flywheel to the foot support means when the first and second resistance pulleys rotate in said one rotational direction so that said flywheel provides resistance to both (i) movement of the foot support means with respect to the support members, and (ii) pivotal movement of the support members.

5. The exercise apparatus as defined in claim 1, wherein the first interacting means comprises:

first and second spaced-apart gears being rotatably disposed about first and second gear axes, respectively; and endless gear intercoupling means disposed in orbital engagement around the first and second gears and being attached to the first and second support members for causing pivotal movement of both said first and second support members to be confined to movement in tandem with simultaneous orbital movement of said intercoupling means around said first and second gears.

6. The exercise apparatus as defined in claim 5:

wherein each of the first and second gears are selected from the group consisting of:

a pulley;

a sprocket; and a toothed gear member;

wherein the gear intercoupling means is selected from the group consisting of:

an endless cable member engageable with a pulley; and an endless chain member comprising a plurality of interconnected links which are engageable with a gear selected from the group consisting of:

a sprocket; and a toothed gear member.

7. The exercise apparatus as defined in claim 1, wherein the first interacting means comprises:

first and second gears rotatably mounted on the first and second support members, respectively;

a third gear rotatably disposed about an axis;

gear intercoupling means extending around and in engagement with the first, second and third gears such that said first, second and third gears are confined to rotate in simultaneous rotational movement with one another; and rotational guide means for guiding the gear intercoupling means along an unimpeded movement path such that said gear intercoupling means extends lengthwise along the first and second support members and is selectively movable in opposing directions along said unimpeded movement path.

8. The exercise apparatus as defined in claim 1, wherein the first interacting means comprises:

a central gear rotatably disposed such that the first and second support members reside on opposing sides of said central gear, respectively;

intercoupling means disposed in engagement around the central gear for intercoupling the first and second support members.

9. An exercise apparatus comprising:

first and second elongate support members being pivotally mounted at first and second pivot points, respectively; and first and second foot support means moveably disposed on the first and second support members, respectively, for supporting a user's feet thereon and moving forwardly and backwardly with respect to the support members;

moving means connected to the support members for pivotally moving said support members about their pivot points from a first position to a second position;

foot support resistive means for resisting movement of the foot support means in at least one direction relative to the support members an axle; and intercoupling means extending around the axle so as to be moveable in orbital movement about the axle, said intercoupling means being fixedly attached to one of the foot support means such that movement of said foot support means with respect to the support member on which said foot support means is disposed is confined to movement in tandem with orbital movement of the intercoupling means about the axle;

wherein the foot support resistive means comprises a flywheel fixedly attached to the axle, and unidirectional clutch means for requiring orbital movement of the intercoupling means in one orbital direction to occur in tandem with rotational movement of the axle.

10. The exercise apparatus as defined in claim 9, further comprising:

a gear member rotatably disposed about the axle and having gear teeth;

wherein the unidirectional clutch means includes means for fixedly attaching the gear to the axle when said gear is rotated in a first rotational direction and releasing said gear when it is rotated in an opposing second rotational direction such that said gear and axle are confined to simultaneous rotational movement with one another in said first rotational direction;

wherein the intercoupling means comprises a cogged belt member engaged with the gear member.

11. An exercise apparatus comprising:

first and second elongate support members being pivotally mounted at first and second pivot points, respectively;

first and second foot support means moveably disposed on the first and second support members, respectively, for supporting a user's feet thereon and moving forwardly and backwardly with respect to the support members;

moving means connected to the support members for pivotally moving said support members about their pivot points from a first position to a second position; and wherein the moving means comprises second interacting means for causing interactive movement between the foot support means such that movement of one of said foot support means in a first direction causes responsive movement of the other foot support means in an opposing second direction.

12. The exercise apparatus as defined in claim 11, wherein the second interacting means further comprises means for causing interactive movement among the support members and foot support means such that (i) pivotal movement of one of said support members causes responsive pivotal movement of the other support member and responsive movement of both foot support means relative to the support members, and (ii) movement of one of the foot support means with respect to the support member on which said foot support means is disposed causes responsive movement of the other foot support means and responsive pivotal movement of both support members.

13. The exercise apparatus as defined in claim 12, wherein the second interacting means further comprises means for causing the interactive movement such that pivotal movement of one of said support members in a first pivotal direction causes responsive pivotal movement of the other support member in an opposing second pivotal direction and responsive movement of both foot support means relative to the support members.

14. The exercise apparatus as defined in claim 13, wherein the second interacting means further comprises means for causing the interactive movement such that the first and second foot support means are caused to move in opposing directions responsive to the pivotal movement of one of said support members in the first pivotal direction.

15. The exercise apparatus as defined in claim 12, wherein the second interacting means further comprises means for causing the interactive movement such that movement of one of the foot support means in a first direction causes responsive movement of the other foot support means in an opposing second direction and responsive pivotal movement of both support members.

16. The exercise apparatus as defined in claim 15, wherein the second interacting means further comprises means for causing the interactive movement such that the first and second support members are caused to pivot in opposing pivotal directions responsive to the movement of one of said foot support means in the first direction.

17. An exercise apparatus comprising:

first and second elongate support members being pivotally mounted at first and second pivot points, respectively;

first and second foot support means moveably disposed on the first and second support members, respectively, for supporting a user's feet thereon and moving forwardly and backwardly with respect to the support members; and first interacting means for causing interactive movement between the support members such that pivotal movement of one of said support members in a first pivotal direction causes responsive pivotal movement of the other support member in an opposing second pivotal direction; and second interacting means for causing interactive movement between the foot support means such that movement of one of said foot support means in a first direction causes responsive movement of the other foot support means in an opposing second direction.

18. The exercise apparatus as defined in claim 17, wherein the second interacting means further includes means for causing interactive movement among the support members and foot support means such that (i) pivotal movement of one of said support members in a first pivotal direction causes responsive pivotal movement of the other support member in an opposing second pivotal direction and responsive movement of both foot support means relative to the support members in opposing directions, and (ii) movement of one of the foot support means in a first direction causes responsive movement of the other foot support means in an opposing direction and responsive pivotal movement of both support members in opposing pivotal directions.

19. The exercise apparatus as defined in claim 17, wherein the first interacting means comprises:

first and second spaced-apart gears being rotatably disposed about first and second gear axes, respectively; and gear intercoupling means disposed in orbital engagement around the first and second gears and being attached to the first and second support members for causing pivotal movement of both said first and second support members to be confined to simultaneous orbital movement of said intercoupling means around said first and second gears.

20. The exercise apparatus as defined in claim 17, wherein the second interacting means comprises:

first and second gears rotatably mounted on the first and second support members, respectively;

a third gear rotatably disposed about an axis;

gear intercoupling means extending around and in engagement with the first, second and third gears such that said first, second and third gears are confined to simultaneous rotational movement with one another, wherein the first and second foot support means are each fixedly attached to said gear intercoupling means;

rotational guide means for guiding the gear intercoupling means along an unimpeded movement path such that said gear intercoupling means extends lengthwise along the first and second support members and is selectively moveable in opposing direction along said unimpeded movement path.

* * * * *